US010976050B2

(12) United States Patent
Ristic et al.

(10) Patent No.: US 10,976,050 B2
(45) Date of Patent: Apr. 13, 2021

(54) SYSTEM AND METHOD FOR PREHEATING A BEATER MILL

(71) Applicant: GENERAL ELECTRIC TECHNOLOGY GMBH, Baden (CH)

(72) Inventors: Dragisa Ristic, Wendlingen (DE); Rajkumar Daniel, Kornwestheim (DE); Frank Michael Kluger, Schwäbisch Gmünd (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 16/849,475

(22) Filed: Apr. 15, 2020

(65) Prior Publication Data

US 2020/0240633 A1 Jul. 30, 2020

Related U.S. Application Data

(63) Continuation of application No. 15/367,463, filed on Dec. 2, 2016, now Pat. No. 10,655,851.

(51) Int. Cl.

| | |
|---|---|
| ***F23K 1/04*** | (2006.01) |
| ***B02C 13/00*** | (2006.01) |
| ***B02C 13/06*** | (2006.01) |
| ***B02C 23/24*** | (2006.01) |
| ***B02C 25/00*** | (2006.01) |
| ***B02C 13/13*** | (2006.01) |
| ***B02C 13/288*** | (2006.01) |

(52) U.S. Cl.

CPC ..... *F23K 1/04* (2013.01); *B02C 13/00* (2013.01); *B02C 13/06* (2013.01); *B02C 13/13* (2013.01);

(Continued)

(58) Field of Classification Search

CPC ..... B02C 13/00; B02C 13/06; B02C 13/13; B02C 13/288; B02C 23/24; B02C 25/00;

(Continued)

(56) References Cited

U.S. PATENT DOCUMENTS 3,447,492 A * 6/1969 Rickard ..... F23J 15/08 110/185

4,090,455 A 5/1978 McCartney (Continued)

FOREIGN PATENT DOCUMENTS

DE 235104 5/1986
DE 294876 10/1991

(Continued)

*Primary Examiner* — Omar Flores Sanchez

(74) *Attorney, Agent, or Firm* — Grogan, Tuccillo & Vanderleeden, LLP

(57) ABSTRACT

A method for preheating a beater mill is provided. The method includes: rotating a beater wheel disposed within the beater mill to facilitate circulation of a gas stream between the beater mill and a furnace fluidly connected to each other via both a pulverized fuel conduit and a flue gas recirculation conduit; generating a burner gas via a burner disposed within the flue gas recirculation conduit such that the burner gas joins and heats the gas stream circulating through the beater mill and the furnace; and adjusting at least one of an air supply and a fuel supply to the burner via a controller based at least in part on one of a temperature of the gas stream at an entrance of the beater mill, a temperature of the gas stream at an exit of the beater mill, and an oxygen level within the beater mill.

19 Claims, 3 Drawing Sheets

(52) U.S. Cl.
CPC ..... *B02C 13/288* (2013.01); *B02C 23/24* (2013.01); *B02C 25/00* (2013.01); *F23K 2201/1006* (2013.01); *F23K 2900/01041* (2013.01)

(58) Field of Classification Search
CPC ..... F23K 1/04; F23K 2201/1006; F23K 2900/01041
See application file for complete search history.

(56) References Cited

U.S. PATENT DOCUMENTS

| | | | | |
|---|---|---|---|---|
| 4,177,951 | A * | 12/1979 | Makuch | F23K 3/02 241/35 |
| 5,263,653 | A | 11/1993 | Pallmann | |
| 5,277,134 | A | 1/1994 | Schlessing et al. | |
| 6,021,966 | A | 2/2000 | Doenges et al. | |
| 6,325,306 | B1 | 12/2001 | Gacanich et al. | |
| 8,104,700 | B2 | 1/2012 | Gietz et al. | |
| 9,944,875 | B2 | 4/2018 | Edel et al. | |
| 10,449,548 | B2 * | 10/2019 | Schmit | B02C 21/02 |
| 2014/0261114 | A1 | 9/2014 | Stegelitz | |
| 2015/0226426 | A1 | 8/2015 | Kuczynski et al. | |
| 2016/0348020 | A1 | 12/2016 | Edel et al. | |
| 2016/0348023 | A1 | 12/2016 | Edel et al. | |
| 2019/0001339 | A1 * | 1/2019 | Schmit | B02C 23/18 |
| 2019/0143336 | A1 | 5/2019 | Kendel et al. | |

FOREIGN PATENT DOCUMENTS

| | | |
|---|---|---|
| DE | 19732219 | 2/1998 |
| DE | 10225126 | 1/2003 |
| EP | 2993399 | 3/2016 |

* cited by examiner

SYSTEM AND METHOD FOR PREHEATING A BEATER MILL

CROSS REFERENCE TO RELATED APPLICATIONS

This application claims the benefit of U.S. application Ser. No. 15/367,463, filed on Dec. 2, 2016, the recitations of all of the foregoing applications being incorporated herein by reference in their entirety.

BACKGROUND

Technical Field

Embodiments of the invention relate generally to beater mills, and more specifically, to a system and method for preheating a beater mill.

Discussion of Art

Many power plants utilize furnaces that combust a fuel, e.g., coal, oil, and/or gas, to produce a hot flue gas and/or steam that drives a turbine which produces electrical power. Many such furnaces burn brown coal, i.e., lignite, which often contains a high amount of water that must be removed prior to combusting the brown coal. As such, many power plants utilize beater mills, also known as "fan beater mills," to pulverize and ventilate, i.e., dry, the brown coal prior to combusting the brown coal in a furnace. Many such beater mills pulverize brown coal via a beater wheel that typically includes hammers that break up the raw brown coal into small particles. The flue gas from the furnace is then usually directed through the beater mill to facilitate ventilation/drying of the pulverized brown coal. The pulverized and dried brown coal is then typically transported to burners for subsequent combustion in the furnace.

Beater mills that utilize the flue gas from a furnace to facilitate ventilation/drying of the pulverized brown coal are usually preheated to temperatures sufficient to dry the brown coal prior to the start of combustion of the brown coal in the furnace. Many methods of preheating a beater mill typically involve using an auxiliary/startup heater, e.g., an oil or gas burner, disposed within the furnace of the encompassing power plant that floods the furnace and the beater mill with hot air. The brown coal is then fed into the beater mill once the beater mill has been heated to a temperature sufficient to dry the pulverized brown coal.

Many such methods of preheating a beater mill, however, risk heating the beater mill to temperatures high enough to cause combustion of the pulverized brown coal within the beater mill or at a point downstream of the beater mill but prior to the furnace. Additionally, many such auxiliary heaters consume large amounts of fuel in order to heat the furnace and the beater mill.

What is needed, therefore, is an improved system and method for preheating a beater mill.

BRIEF DESCRIPTION

In an embodiment, a method for preheating a beater mill is provided. The method includes: rotating a beater wheel disposed within the beater mill to facilitate circulation of a gas stream between the beater mill and a furnace fluidly connected to each other via both a pulverized fuel conduit and a flue gas recirculation conduit; generating a burner gas via a burner disposed within the flue gas recirculation conduit such that the burner gas joins and heats the gas stream circulating through the beater mill and the furnace; and adjusting at least one of an air supply and a fuel supply to the burner via a controller based at least in part on one of a temperature of the gas stream at an entrance of the beater mill, a temperature of the gas stream at an exit of the beater mill, and an oxygen level within the beater mill.

In another embodiment, a system for preheating a beater mill is provided. The system includes a beater wheel, a furnace, a pulverized fuel conduit, a flue gas recirculation conduit, a burner, and a controller. The beater wheel is disposed within the beater mill. The furnace is operative to receive a fuel from the beater mill. The pulverized fuel conduit fluidly connects the beater mill to the furnace and is operative to allow the fuel to flow from the beater mill to the furnace. The flue gas recirculation conduit fluidly connects the furnace to the beater mill so as to facilitate circulation of a gas stream through the beater mill and the furnace via the flue gas recirculation conduit and the pulverized fuel conduit. The burner is disposed within the flue gas recirculation conduit and operative to generate a burner gas that joins and heats the gas stream. The burner includes an air supply and a fuel supply. The controller is in electronic communication with at least one of the air supply and the fuel supply and operative to adjust at least one of the air supply and the fuel supply based at least in part on one of a temperature of the gas stream at an entrance of the beater mill, a temperature of the gas stream at an exit of the beater mill, and an oxygen level within the beater mill.

In yet another embodiment, a method for preheating a beater mill is provided. The method includes: rotating a beater wheel disposed within the beater mill to facilitate circulation of a gas stream between the beater mill and a furnace fluidly connected to the beater mill via a pulverized fuel conduit and a flue gas recirculation conduit; generating a burner gas at stoichiometric conditions via a burner disposed within the flue gas recirculation conduit such that the burner gas joins and heats the gas stream circulating through the beater mill and the furnace; and adjusting at least one of an air supply and a fuel supply to the burner via a controller such that the temperature of the gas stream at the entrance of the beater mill is within a target mill entrance gas temperature range. The method further includes: when the temperature of the gas stream at the entrance of the beater mill is within the target mill entrance gas temperature range, further adjusting at least one of the air supply and the fuel supply to the burner via a controller such that the temperature of the gas stream at the exit of the beater mill is within a target mill exit gas temperature range. The method further includes: when the temperature of the gas stream at the exit of the beater mill is within the target mill exit gas temperature range, reducing the air supply to the burner via the controller such that the oxygen level within the beater mill is below a maximum mill oxygen threshold. The method further includes: when the oxygen level within the beater mill is below a maximum mill oxygen threshold, introducing the fuel from a fuel source into the beater mill.

DRAWINGS

The present invention will be better understood from reading the following description of non-limiting embodiments, with reference to the attached drawings, wherein below:

Figure 1:
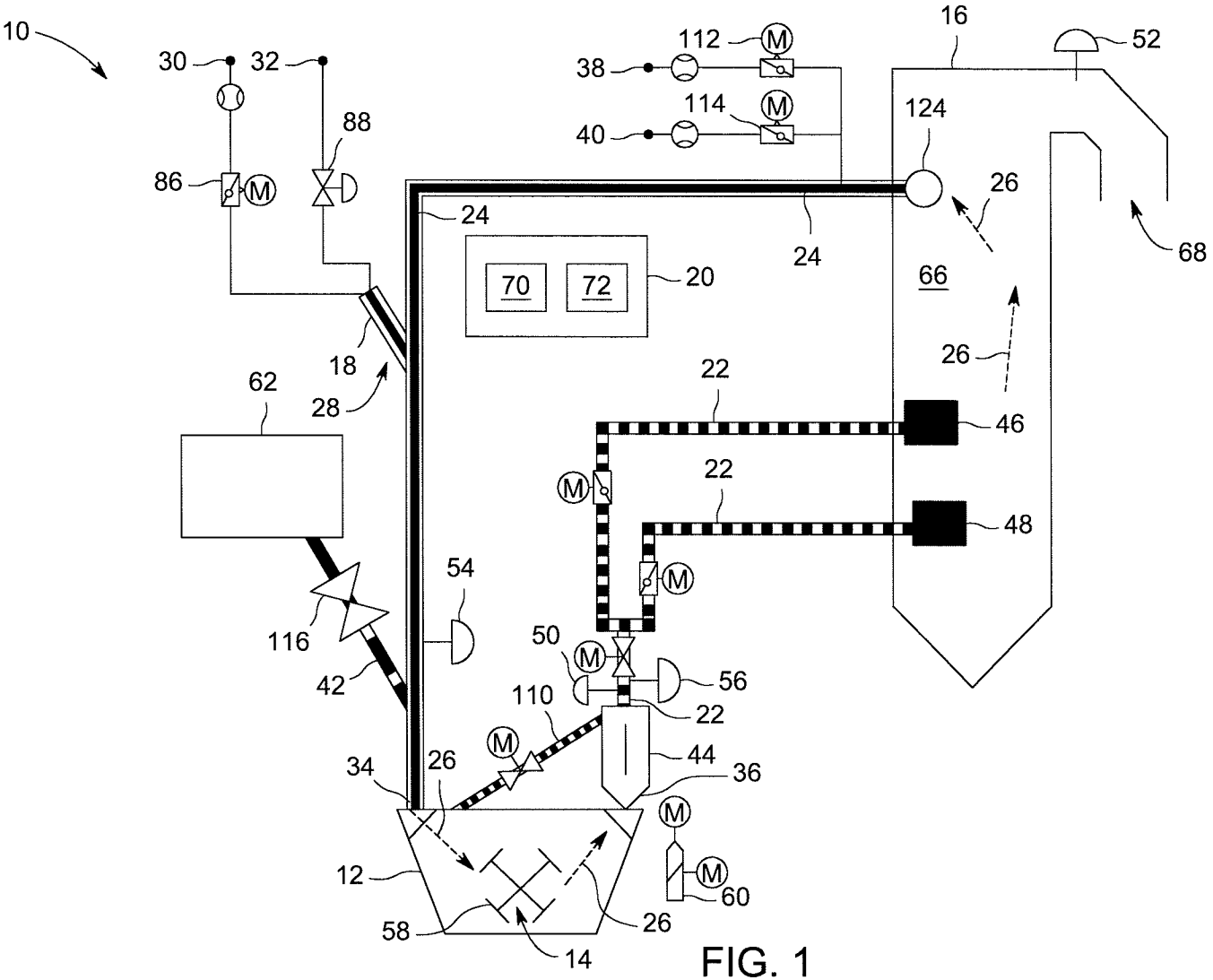
FIG. 1 is a block diagram of a system for preheating a beater mill in accordance with an embodiment of the invention.
Figure 4:
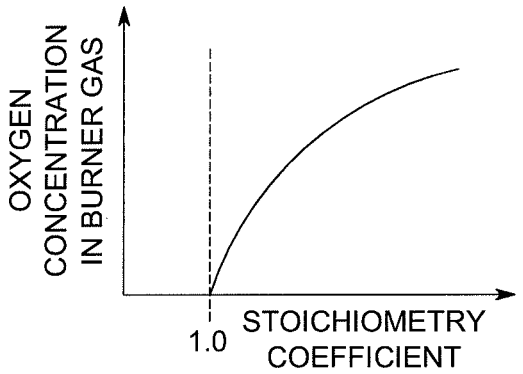
Figure 5:
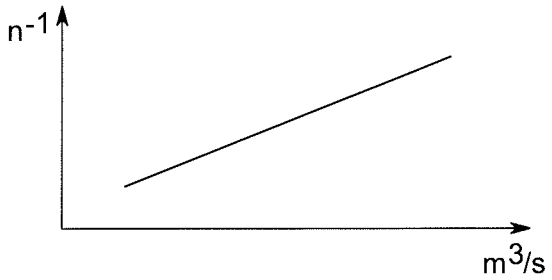

FIG. 4 is a chart that depicts the relationship between the concentration of oxygen in a burner gas produced by the burner of FIG. 1 and a stoichiometry coefficient of the underlying combustion reaction in accordance with an embodiment of the invention; and FIG. 5 is a chart that depicts the relationship between the rotations of a beater wheel of the system of FIG. 1 and a resulting beater mill flow in accordance with an embodiment of the invention.

DETAILED DESCRIPTION

Reference will be made below in detail to exemplary embodiments of the invention, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly. The term "real-time," as used herein, means a level of processing responsiveness that a user senses as sufficiently immediate or that enables the processor to keep up with an external process. As used herein, "electrically coupled," "electrically connected," and "electrical communication" mean that the referenced elements are directly or indirectly connected such that an electrical current, or other communication medium, may flow from one to the other. The connection may include a direct conductive connection, i.e., without an intervening capacitive, inductive or active element, an inductive connection, a capacitive connection, and/or any other suitable electrical connection. Intervening components may be present. As also used herein, the term "fluidly connected" means that the referenced elements are connected such that a fluid (to include a liquid, gas, and/or plasma) may flow from one to the other. Accordingly, the terms "upstream" and "downstream," as used herein, describe the position of the referenced elements with respect to a flow path of a fluid and/or gas flowing between and/or near the referenced elements. Further, the term "stream," as used herein with respect to particles, means a continuous or near continuous flow of particles. As also used herein, the term "heating contact" means that the referenced objects are in proximity of one another such that heat/thermal energy can transfer between them.

Additionally, while the embodiments disclosed herein are primarily described with respect to coal fired power plants, and in particular brown coal/lignite fired power plants, it is to be understood that embodiments of the present invention may be applicable to any system or process that requires a fuel to be pulverized and ventilated/dried, e.g., a biomass furnace.

Referring now to FIG. 1, a system 10 for preheating a beater mill 12 in accordance with embodiments of the invention is shown. The system 10 includes a beater wheel 14, a furnace 16, a burner 18, and a controller 20. The beater wheel 14 is disposed within the beater mill 12 and is operative to pulverize and ventilate/dry a fuel, e.g., coal, to include brown coal/lignite, received by the beater mill 12. The furnace 16 is operative to receive the fuel from the beater mill 12 via a pulverized fuel conduit 22 that fluidly connects the furnace 16 to the beater mill 12. The furnace 16 is further fluidly connected to the beater mill 12 via a flue gas recirculation conduit 24 so as to facilitate circulation of a gas stream, generally designated by arrows 26, through the beater mill 12 and the furnace 16. The burner 18 is disposed within the flue gas recirculation conduit 24 and is operative to generate a burner gas, generally designated by arrow 28, that joins and heats the gas stream 26. The controller 20 is operative to adjust at least one of an air supply 30 and a fuel supply 32 of the burner 18 based at least in part on one of a temperature $T_1$ of the gas stream 26 at an entrance 34 of the beater mill 12, a temperature $T_2$ of the gas stream 26 at an exit 36 of the beater mill 12, and an oxygen level $O_{bm}$ within the beater mill 12. In embodiments, the system 10 may further include a primary air source for 38, a cold gas air source 40, a coal chute 42, a classifier 44, one or more fuel burners 46, 48, one or more oxygen sensors 50, 52, and one or more temperature sensors 54, 56.

The beater wheel 14 may include one or more hammers 58 disposed on shafts connected to a rotor which is rotated by a motor 60. The entrance 34 is fluidly connected to the flue gas recirculation conduit 24, and the exit 36 is fluidly connected to the pulverized fuel conduit 22. As will be appreciated, in embodiments, the coal chute 42 may be fluidly connected to a fuel source 62 from which fuel, e.g., brown coal, is introduced into the beater mill 12 via the recirculation conduit 24.

The furnace 16 includes a combustion chamber 66, and an outlet 68. The fuel burners 46, 48 are disposed within the combustion chamber 66 and fluidly connected to the pulverized fuel conduit 22. As stated above, the furnace 16 is also fluidly connected to the flue gas recirculation conduit 24.

The controller 20 may include at least one processor 70 and a memory device 72. While not shown for the purpose of preserving clarity in FIG. 1, it will be understood that the controller 20 may be in electrical communication with the various components of the system 10 to include the various valves, dampers, and other processes control devices which are disclosed herein.

Figure 2:
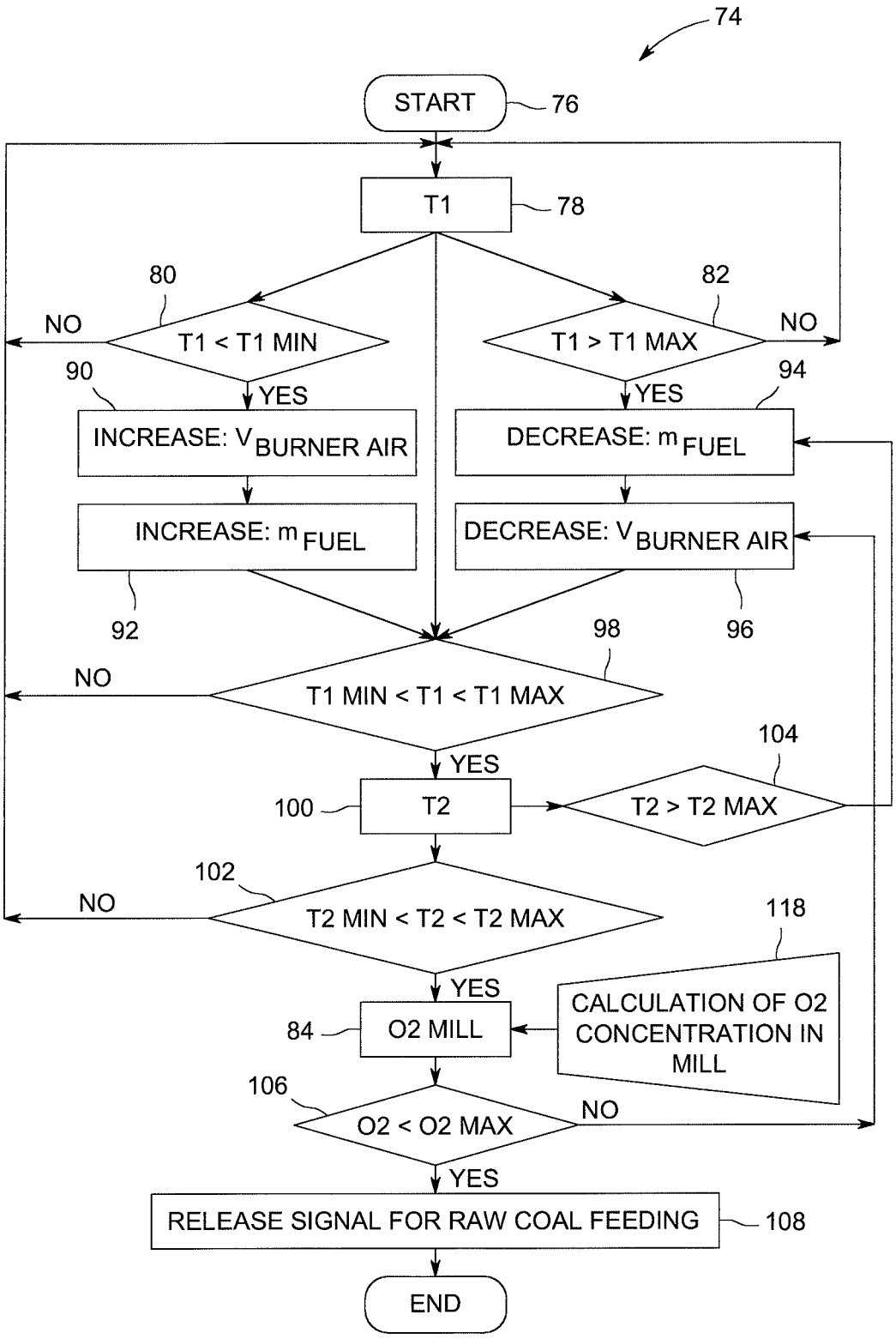
FIG. 2 is a flow chart that depicts a method of preheating a beater mill utilizing the system of FIG. 1 in accordance with an embodiment of the invention.

Turning now to FIG. 2, a method 74 of preheating the beater mill 12 in accordance with embodiments of the invention, is shown. As will be appreciated, preheating the beater mill 12 is the process of transitioning the beater mill 12 from a cold state, i.e., a shutdown condition, to an operational state, i.e., a state where the beater mill 12 has a temperature sufficient to ventilate/dry the pulverized fuel while having an internal oxygen level/concentration ($O_{2bm}$) low enough to reduce the risk of the pulverized fuel combusting within the beater mill 12.

Accordingly, in operation, the controller 20 starts 76 preheating of the beater mill 12 by rotating the beater wheel 14 which drives the circulation of the gas stream 26 through the beater mill 12 and the furnace 16. In embodiments, the controller 20 may rotate the beater wheel 14 at 450 rotations per minute ("RPM"). The controller 20 then ignites/starts the burner 18 which combusts air from the air source 30 with fuel from the fuel source 32 to generate/produce the burner gas 28. As will be appreciated, in embodiments, the fuel combusted by the burner 18 from the fuel source 32 may be a solid fuel, e.g., coal, a liquid fuel, e.g., oil, and/or a gas, e.g., natural gas. The air combusted by the burner 18 from the air source 30 may be compressed air or near pure oxygen. As stated above, the generated burner gas 28 enters/joins the gas stream 26 in the flue gas recirculation conduit 24 such that the burner gas 28 heats the gas stream 26, and the gas stream 26 enters the beater mill 12 via the entrance 34 where it heats the beater mill 12. The burner gas 28 may include carbon monoxide ("CO") which may subsequently oxidize to carbon dioxide ("$CO_2$") within the flue gas recirculation conduit 24. As will further be appreciated, in embodiments, the burner 18 operates at stoichiometric conditions. In other words, in embodiments, the burner 18 generates the gas stream 28 such that all, or nearly all, of the air from the air source 30 is consumed by the burner 18. As will be appreciated, operating the burner 18 at stoichiometric conditions limits the amount of $O_2$ being introduced into the gas stream 26 via the burner 18. It is to be understood, however, that in other embodiments, the burner 18 may operate above and/or under stoichiometric conditions.

As will be also appreciated, in embodiments, the controller 20 may be in electronic communication with the primary air source 38 and the cold gas source 40 such that the controller 20 can regulate the flow rates and/or the temperature of the gas stream 26 by adjusting valves 112 (FIG. 1) and/or 114 (FIG. 1) so as to control an amount of air and/or cold gas introduced into the gas stream 26 via the primary air source 38 and/or the cold gas source 40, respectively. Further, the controller 20 may also be in electronic communication with a valve 116 that controls the flow rate of the fuel from the fuel source 62 into the recirculation conduit 24 via the coal chute 42. As will be understood, false air may be carried along with the fuel within the coal chute 42, or otherwise caused to flow through the fuel chute 42, such that the false air is introduced into the gas stream 26. The amounts of gas contributed to the gas stream 26 by the primary air source 38, cold gas source 40, and false air are referred to herein as the "primary air flow" ($F_{pa}$), the "cold gas flow" ($F_{gc}$), and the "false air flow" ($F_{fg}$), respectively. As will be appreciated, in embodiments, $F_{pa}$ has a known oxygen concentration ($O_{2pa}$), $F_{gc}$ has a known oxygen concentration ($O_{2cg}$), and $F_{fg}$ has a known oxygen concentration ($O_{2fg}$).

As further shown in FIG. 2, once the gas stream 26 has begun circulating and heated, the controller 20 reads/obtains 78 $T_1$ from the temperature sensor 54 and determines 80 and 82 if $T_1$ is within a mill entrance gas temperature range $T_{1min}$-$T_{1max}$. As will be appreciated, in embodiments, $T_{1min}$ may be 300° C. and $T_{1max}$ may be 820° C. In such embodiments, if the controller 20 determines 80 and 82 that $T_1$ is within $T_{1min}$-$T_{1max}$, the controller 20 may then proceed to read 84 $O_{2bm}$ via the oxygen sensor 50 which, in embodiments, may be disposed in the beater mill 12 or in the pulverized fuel conduit 22 downstream of the beater mill 12. If the controller 20 determines 80 and 82 that $T_1$ is not within $T_{1min}$-$T_{1max}$, the controller 20 may adjust the air supply 30 and/or the fuel supply 32 to the burner 18 via valves 86 (FIG. 1) and 88 (FIG. 1), respectively. As will be appreciated, in embodiments, value 86 may provide a measurement of the rate of flow ($V_{burner\ air}$) of the air from the air supply 30 to the burner 18, and value 88 may provide a measurement of the rate of flow ($M_{fuel}$) of the fuel from the fuel supply 32 to the burner 18. For example, if the controller 20 determines 80 that $T_1<T_{1min}$, the controller 20 may then increase 90 the air supply 30 and/or increase 92 the fuel supply 32 to the burner 18. Alternatively, if the controller 20 determines 82 that $T_1>T_{1max}$, the controller 20 may then decrease 94 the fuel supply 32 and/or decrease 96 the air supply 30 to the burner 18. After having adjusted 90, 92, 94, and/or 96 the air supply 30 and/or the fuel supply 32 to the burner 18, the controller 20 may then again read and determine 98 if $T_1$ is within $T_{1min}$-$T_{1max}$. If $T_1$ is within $T_{1min}$-$T_{1max}$, the controller 20 may then read/sample 84 $O_{2bm}$. If the controller 20 determines 98 $T_1$ is not within $T_{1min}$-$T_{1max}$, the controller 20 may continue to read/sample 78, 80, 82 $T_1$ and/or adjust 90, 92, 94, and/or 96 the air supply 30 and/or the fuel supply 32 as discussed above.

As further shown in FIG. 2, in some embodiments, if $T_1$ is within $T_{1min}$-$T_{1max}$, the controller 20 may additionally read/sample 100 $T_2$ in order to determine 102 if $T_2$ is within a target mill exit gas temperature range $T_{2min}$-$T_{2max}$. As will be appreciated, in embodiments, $T_{2min}$ may be 80° C. and $T_{2max}$ may be200° C. If the controller 20 determines 104 that $T_2>T_{2max}$, then the controller 20 may adjust the air supply 30 and/or the fuel supply 32 to the burner 18. For example, in embodiments, if the controller 20 determines 104 that $T_2>T_{2max}$, the controller 20 may then decrease 94 the fuel supply 32 and/or decrease 96 the air supply 30 to the burner 18, and then retest/resample 98 $T_1$ to see if $T_1$ is within $T_{1min}$-$T_{1max}$. If the controller 20 determines 102 that $T_2<T_{2max}$ but not within $T_{2min}$-$T_{2max}$, i.e., $T_2<T_{2min}$, the controller 20 may continue heating the gas stream 26 via the burner 18 and resampling and/or adjusting $T_1$ and $T_2$ in the manner as discussed above. If the controller 20 determines 102 that $T_2$ is within $T_{2min}$-$T_{2max}$, then the controller 20 may read/sample 84 $O_{2bm}$. As will be appreciated, in some embodiments, the controller 20 may sample $T_2$ without sampling $T_1$.

After having read/sampled 84 $O_{2bm}$, the controller 20 may then determine 106 whether $O_{2bm}$ is below a maximum mill oxygen threshold $O_{2bmMax}$. In embodiments, $O_{2bmMax}$ may be 12% by volume (wet). In other words, the gas steam 26 is inert when it enters the beater mill 12. If the controller 20 determines 106 that $O_{2bm}>O_{2bmMax}$, then the controller 20 may decrease 96 the air supply 30 to the burner 18 and resample/adjust $T_1$, $T_2$, and/or $O_{2bm}$ in the manner as discussed above. If the controller 20 determines 106 that $O_{2bm}<O_{2bmMax}$, the controller 20 may then call/signal 108 for the introduction of fuel into the beater mill 12 via valve 116 and coal chute 42.

Upon introduction of the fuel into the beater mill 12, the beater wheel 14 pulverizes the fuel via the hammers 58, and ventilates/dries the pulverized fuel via the gas stream 26. The pulverized and ventilated/dried fuel is then transported by the gas stream 26 via the pulverized fuel conduit 22 to the furnace 16. As will be appreciated, in embodiments, the classifier 44 may be disposed within the pulverized fuel conduit 22 such that the classifier 44 only allows fine particles of fuel to pass through to the furnace 16 while redirecting coarse particles of fuel back to the beater mill 12 via conduit 110 (FIG. 1) where they may be further ground/pulverized until they are fine enough to pass through the classifier 44.

Upon arriving at the furnace 16, the pulverized and ventilated/dried fuel is combusted by the burners 46, 48 in the combustion chamber 66 so as to produce a hot flue gas. The flue gas from the combustion of the fuel in the furnace 16 joins and heats the gas stream 26 such that it flows into the beater mill 12 via the flue gas recirculation conduit 24 so as to facilitate continued ventilation/drying of the pulverized fuel. In other words, the system 10 becomes self-sustaining with respect to the ventilation/drying and combustion of the fuel such that the burner 18 may be turned off after a period of time, e.g., one hour.

As will be further appreciated, as opposed to directly reading/sampling 80 $O_{2bm}$ via the oxygen sensor 50, some embodiments may calculate $O_{2bm}$. Accordingly, in embodiments, the controller 20 may calculate $O_{2bm}$ based at least in part on an oxygen level $O_{2fr}$ within the furnace 16. In such embodiments, $O_{2fr}$ may be obtained by the oxygen sensor 52 which may be disposed in the furnace 16, e.g., in the combustion chamber 66, or in the outlet 68 of the furnace 16. By calculating and/or measuring the flow rate of the gas stream 26, and by knowing $O_{2fr}$, the controller 20 can calculate $O_{2bm}$.

Figure 3:
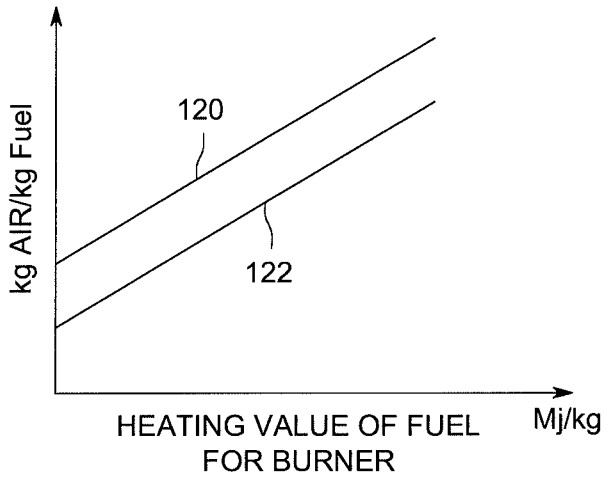
FIG. 3 is chart that depicts the stoichiometric relationship between fuel and air consumed by a burner of the system of FIG. 1 in accordance with an embodiment of the invention.

For example, as shown by the graph in FIG. 3, in embodiments, the contribution to the flow rate of the gas stream 26 made by the burner gas 18, also referred to herein as the "burner gas flow" ($F_{bg}$), can be calculated based on the stoichiometric relationship between the amount of air and fuel combusted by the burner 18. In particular, the lines 120 and 122 represent the stoichiometric air consumed and the amount of burner gas 28 produced by the burner 18, respectively. As can be seen in FIG. 3, as the heating value of the fuel supplied to the burner 18 is increased, the amount of air required to maintain stoichiometric combustion increases, and the amount of burner gas 28, i.e., $F_{bg}$, produced by the burner 18 also increases.

As shown in FIG. 4, the oxygen concentration $O_{2bg}$ in the burner gas 28 can be calculated based on the known stoichiometric relationship in the underlying chemical equation of the combustion reaction that produces the burner gas 28. For example, at a stoichiometric coefficient of 1.0, the burner gas 28 contains a near zero amount of $O_2$. Increasing the stoichiometric coefficient of the underlying reaction that produces the burner gas 28, however, increases the amount of $O_2$ in the burner gas 28.

Further, as shown in FIG. 5, the contribution to the flow rate of the gas stream 26 by the beater mill 12, also referred to herein as the "beater mill flow" ($F_{bm}$), via rotation of the beater wheel 14, can be derived from the RMP of the beater wheel 14. For example, the vertical axis ($n^{-1}$) of the chart in FIG. 5 represents the RPM of the beater wheel 14, and the horizontal axis ($m^3/s$) represents $F_{bm}$. Thus, as can be seen, as the RPMs of the beater wheel 14 increase, so does $F_{bm}$.

Accordingly, the flow rate of the gas stream 26 at an entrance 124 (FIG. 1) of the flue gas recirculation conduit 24 in the furnace 16, also referred to herein as the "furnace flow" ($F_{fr}$) can be calculated by subtracting $F_{bg}$, $F_{pa}$, $F_{cg}$, and $F_{fg}$ from $F_{bg}$. As will be appreciated, $O_{2bm}$ may then be calculated from $F_{bg}$, $F_{bm}$, $F_{fr}$, $F_{pa}$, $F_{gc}$, $F_{fg}$, $O_{2fr}$, $O_{pa}$, $O_{cg}$, and $O_{fa}$.

Finally, it is also to be understood that the system 10 may include the necessary electronics, software, memory, storage, databases, firmware, logic/state machines, microprocessors, communication links, displays or other visual or audio user interfaces, printing devices, and any other input/output interfaces to perform the functions described herein and/or to achieve the results described herein. For example, as stated above, the system 10 may include at least one processor 70 and system memory/data storage structures 72 in the form of a controller 20. The memory may include random access memory ("RAM") and read-only memory ("ROM"). The at least one processor may include one or more conventional microprocessors and one or more supplementary co-processors such as math co-processors or the like. The data storage structures discussed herein may include an appropriate combination of magnetic, optical and/or semiconductor memory, and may include, for example, RAM, ROM, flash drive, an optical disc such as a compact disc and/or a hard disk or drive.

Additionally, a software application that provides for control over one or more of the various components of the system 10, e.g., the beater will motor 60, valves 86, 88, 112, 114, and/or 116, may be read into a main memory of the at least one processor from a computer-readable medium. The term "computer-readable medium", as used herein, refers to any medium that provides or participates in providing instructions to the at least one processor 70 (or any other processor of a device described herein) for execution. Such a medium may take many forms, including but not limited to, non-volatile media and volatile media. Non-volatile media include, for example, optical, magnetic, or opto-magnetic disks, such as memory. Volatile media include dynamic random access memory ("DRAM"), which typically constitutes the main memory. Common forms of computer-readable media include, for example, a floppy disk, a flexible disk, hard disk, magnetic tape, any other magnetic medium, a CD-ROM, DVD, any other optical medium, a RAM, a PROM, an EPROM or EEPROM (electronically erasable programmable read-only memory), a FLASH-EEPROM, any other memory chip or cartridge, or any other medium from which a computer can read.

While in embodiments, the execution of sequences of instructions in the software application causes the at least one processor to perform the methods/processes described herein, hard-wired circuitry may be used in place of, or in combination with, software instructions for implementation of the methods/processes of the present invention. Therefore, embodiments of the present invention are not limited to any specific combination of hardware and/or software.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of the invention without departing from its scope.

For example, in an embodiment, a method for preheating a beater mill is provided. The method includes: rotating a beater wheel disposed within the beater mill to facilitate circulation of a gas stream between the beater mill and a furnace fluidly connected to each other via both a pulverized fuel conduit and a flue gas recirculation conduit; generating a burner gas via a burner disposed within the flue gas recirculation conduit such that the burner gas joins and heats the gas stream circulating through the beater mill and the furnace; and adjusting at least one of an air supply and a fuel supply to the burner via a controller based at least in part on one of a temperature of the gas stream at an entrance of the beater mill, a temperature of the gas stream at an exit of the beater mill, and an oxygen level within the beater mill. In certain embodiments, the controller adjusts at least one of the air supply and the fuel supply of the burner such that the burner generates the burner gas at stoichiometric conditions. In certain embodiments, adjusting at least one of an air supply and a fuel supply to the burner via a controller includes: adjusting at least one of the air supply and the fuel supply such that at least one of the temperature of the gas stream at the entrance of the beater mill is within a target mill entrance gas temperature range, and the temperature of the gas stream at the exit of the beater mill is within a target mill exit gas temperature range. In certain embodiments, adjusting at least one of an air supply and a fuel supply to the burner via a controller further includes adjusting at least one of the air supply and the fuel supply such that the oxygen level within the beater mill is below a maximum mill oxygen threshold. In certain embodiments, the method further includes obtaining the oxygen level within the beater mill from an oxygen sensor disposed in the beater mill or in the pulverized fuel conduit downstream of the beater mill. In certain embodiments, the method further includes calculating the oxygen level within the beater mill via the controller based at least in part on an oxygen level within the furnace obtained by an oxygen sensor disposed in the furnace or in an outlet of the furnace. In certain embodiments, the method further includes introducing the fuel into the beater mill from a fuel source when the oxygen level within the beater mill is below the maximum mill oxygen threshold. In certain embodiments, the fuel is coal.

Other embodiments provide for a system for preheating a beater mill. The system includes a beater wheel, a furnace, a pulverized fuel conduit, a flue gas recirculation conduit, a burner, and a controller. The beater wheel is disposed within the beater mill. The furnace is operative to receive a fuel from the beater mill. The pulverized fuel conduit fluidly connects the beater mill to the furnace and is operative to allow the fuel to flow from the beater mill to the furnace. The flue gas recirculation conduit fluidly connects the furnace to the beater mill so as to facilitate circulation of a gas stream through the beater mill and the furnace via the flue gas recirculation conduit and the pulverized fuel conduit. The burner is disposed within the flue gas recirculation conduit and operative to generate a burner gas that joins and heats the gas stream. The burner includes an air supply and a fuel supply. The controller is in electronic communication with at least one of the air supply and the fuel supply and operative to adjust at least one of the air supply and the fuel supply based at least in part on one of a temperature of the gas stream at an entrance of the beater mill, a temperature of the gas stream at an exit of the beater mill, and an oxygen level within the beater mill. In certain embodiments, the circulation of the gas stream through the beater mill and the furnace is powered by the beater wheel. In certain embodiments, the controller is further operative to adjust at least one of the air supply and the fuel supply of the burner such that the burner generates the burner gas at stoichiometric conditions. In certain embodiments, the controller is further operative to adjust at least one of the air supply and the fuel supply such that the oxygen level within the beater mill is below a maximum mill oxygen threshold, and at least one of: the temperature of the gas stream at the entrance of the beater mill is within a target mill entrance gas temperature range; and the temperature of the gas stream at the exit of the beater mill is within a target mill exit gas temperature range. In certain embodiments, the system further includes an oxygen sensor disposed in the beater mill or in the pulverized fuel conduit downstream of the beater mill, and the controller obtains the oxygen level within the beater mill from the oxygen sensor. In certain embodiments, the system further includes an oxygen sensor disposed in the furnace or in an outlet of the furnace, and the controller is further operative to calculate the oxygen level within the beater mill based at least in part on an oxygen level obtained by the oxygen sensor. In certain embodiments, the system further includes a fuel source operative to supply the fuel to the beater mill, and the controller is further in electronic communication with the fuel source and operative to introduce the fuel into the beater mill from the fuel source when the oxygen level within the beater mill is below the maximum mill oxygen threshold, and at least one of: the temperature of the gas stream at the entrance of the beater mill is within the target mill entrance gas temperature range; and the temperature of the gas stream at the exit of the beater mill is within the target mill exit gas temperature range. In certain embodiments, the fuel is coal.

Yet still other embodiments provide for a method for preheating a beater mill. The method includes: rotating a beater wheel disposed within the beater mill to facilitate circulation of a gas stream between the beater mill and a furnace fluidly connected to the beater mill via a pulverized fuel conduit and a flue gas recirculation conduit; generating a burner gas at stoichiometric conditions via a burner disposed within the flue gas recirculation conduit such that the burner gas joins and heats the gas stream circulating through the beater mill and the furnace; and adjusting at least one of an air supply and a fuel supply to the burner via a controller such that the temperature of the gas stream at the entrance of the beater mill is within a target mill entrance gas temperature range. The method further includes: when the temperature of the gas stream at the entrance of the beater mill is within the target mill entrance gas temperature range, further adjusting at least one of the air supply and the fuel supply to the burner via a controller such that the temperature of the gas stream at the exit of the beater mill is within a target mill exit gas temperature range. The method further includes: when the temperature of the gas stream at the exit of the beater mill is within the target mill exit gas temperature range, reducing the air supply to the burner via the controller such that the oxygen level within the beater mill is below a maximum mill oxygen threshold. The method further includes: when the oxygen level within the beater mill is below a maximum mill oxygen threshold, introducing the fuel from a fuel source into the beater mill. In certain embodiments, the method further includes obtaining the oxygen level within the beater mill from an oxygen sensor disposed in the beater mill or in the pulverized fuel conduit downstream of the beater mill. In certain embodiments, the method further includes calculating the oxygen level within the beater mill via the controller based at least in part on an oxygen level obtained by an oxygen sensor disposed in the furnace or in an outlet of the furnace. In certain embodiments, calculating the oxygen level within the beater mill via the controller based at least in part on an oxygen level obtained by an oxygen sensor disposed in the furnace or in an outlet of the furnace includes calculating a flow rate of the gas stream based at least in part on a rotational speed of the beater wheel.

Accordingly, by adjusting the air supply and/or the fuel supply to the burner in the flue gas recirculation conduit based at least in part on $T_1$, $T_2$, and/or $O_{2bm}$, some embodiments of the present invention do not require an auxiliary boiler startup burner system within the furnace. Thus, some embodiments of the present invention may provide for up to a 90% reduction in the secondary fuel consumption of an encompassing power plant. Additionally, some embodiments provide for a beater mill and furnace having improved part loading operations and flexibility over existing systems.

While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted as such, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

What is claimed is:

1. A method for preheating a beater mill comprising:

rotating a beater wheel disposed within the beater mill to facilitate circulation of a gas stream between the beater mill and a furnace fluidly connected to each other via both a pulverized fuel conduit and a flue gas recirculation conduit;

generating a burner gas via a burner disposed within the flue gas recirculation conduit such that the burner gas joins and heats the gas stream circulating through the beater mill and the furnace, wherein the gas stream circulating through the beater mill and the furnace is powered by the beater wheel; and adjusting at least one of an air supply and a fuel supply to the burner via a controller based at least in part on one of a temperature of the gas stream at an entrance of the beater mill, a temperature of the gas stream at an exit of the beater mill, and an oxygen level within the beater mill.

2. The method of claim 1, wherein the controller adjusts at least one of the air supply and the fuel supply of the burner such that the burner generates the burner gas at stoichiometric conditions.

3. The method of claim 1, wherein adjusting at least one of an air supply and a fuel supply to the burner via a controller comprises:

adjusting at least one of the air supply and the fuel supply such that at least one of the temperature of the gas stream at the entrance of the beater mill is within a target mill entrance gas temperature range, and the temperature of the gas stream at the exit of the beater mill is within a target mill exit gas temperature range.

4. The method of claim 3, wherein adjusting at least one of an air supply and a fuel supply to the burner via a controller further comprises:

adjusting at least one of the air supply and the fuel supply such that the oxygen level within the beater mill is below a maximum mill oxygen threshold.

5. The method of claim 4 further comprising:

obtaining the oxygen level within the beater mill from an oxygen sensor disposed in the beater mill or in the pulverized fuel conduit downstream of the beater mill.

6. The method of claim 4 further comprising:

calculating the oxygen level within the beater mill via the controller based at least in part on an oxygen level within the furnace obtained by an oxygen sensor disposed in the furnace or in an outlet of the furnace.

7. The method of claim 4 further comprising:

introducing a fuel into the beater mill from a fuel source when the oxygen level within the beater mill is below the maximum mill oxygen threshold.

8. The method of claim 7 further comprising:

introducing the fuel into the beater mill from a fuel source when at least one of:

the temperature of the gas stream at the entrance of the beater mill is within the target mill entrance gas temperature range; and the temperature of the gas stream at the exit of the beater mill is within the target mill exit gas temperature range.

9. The method of claim 7, wherein the fuel is coal.

10. A method for preheating a beater mill comprising:

rotating a beater wheel disposed within the beater mill to facilitate circulation of a gas stream between the beater mill and a furnace fluidly connected to each other via both a pulverized fuel conduit and a flue gas recirculation conduit;

generating a burner gas via a burner disposed within the flue gas recirculation conduit such that the burner gas joins and heats the gas stream circulating through the beater mill and the furnace;

adjusting at least one of an air supply and a fuel supply to the burner via a controller such that the burner generates the burner gas at stoichiometric conditions and based at least in part on one of a temperature of the gas stream at an entrance of the beater mill, a temperature of the gas stream at an exit of the beater mill, and an oxygen level within the beater mill.

11. The method of claim 10, further including:

adjusting at least one of the air supply and the fuel supply such that the oxygen level within the beater mill is below a maximum mill oxygen threshold, and at least one of:

the temperature of the gas stream at the entrance of the beater mill is within a target mill entrance gas temperature range; and the temperature of the gas stream at the exit of the beater mill is within a target mill exit gas temperature range.

12. The method of claim 11, wherein the system further comprises:

obtaining the oxygen level within the beater mill from an oxygen sensor disposed in the beater mill or in the pulverized fuel conduit downstream of the beater mill.

13. The method of claim 12, wherein the method further comprises:

calculating, with the controller, the oxygen level within the beater mill based at least in part on an oxygen level obtained by an oxygen sensor disposed in the furnace or in an outlet of the furnace.

14. The method of claim 12, wherein the method further comprises:

supplying fuel to the beater mill from a fuel source, and introducing, with the controller that is further in electronic communication with the fuel source, the fuel into the beater mill from the fuel source when the oxygen level within the beater mill is below the maximum mill oxygen threshold, and at least one of:

the temperature of the gas stream at the entrance of the beater mill is within the target mill entrance gas temperature range; and the temperature of the gas stream at the exit of the beater mill is within the target mill exit gas temperature range.

15. The method of claim 10, wherein the fuel is coal.

16. A method for preheating a beater mill comprising:

rotating a beater wheel disposed within the beater mill to facilitate circulation of a gas stream between the beater mill and a furnace fluidly connected to the beater mill via a pulverized fuel conduit and a flue gas recirculation conduit;

generating a burner gas at stoichiometric conditions via a burner disposed within the flue gas recirculation conduit such that the burner gas joins and heats the gas stream circulating through the beater mill and the furnace;

adjusting at least one of an air supply and a fuel supply to the burner via a controller such that the temperature of the gas stream at a entrance of the beater mill is within a target mill entrance gas temperature range;

when the temperature of the gas stream at the entrance of the beater mill is within the target mill entrance gas temperature range, further adjusting at least one of the air supply and the fuel supply to the burner via the controller such that the temperature of the gas stream at a exit of the beater mill is within a target mill exit gas temperature range;

when the temperature of the gas stream at the exit of the beater mill is within the target mill exit gas temperature range, reducing the air supply to the burner via the controller such that a oxygen level within the beater mill is below a maximum mill oxygen threshold; and when the oxygen level within the beater mill is below the maximum mill oxygen threshold, introducing a fuel from a fuel source into the beater mill.

17. The method of claim 16 further comprising:

obtaining the oxygen level within the beater mill from an oxygen sensor disposed in the beater mill or in the pulverized fuel conduit downstream of the beater mill.

18. The method of claim 16, wherein the method further comprises:

calculating the oxygen level within the beater mill via the controller based at least in part on an oxygen level obtained by an oxygen sensor disposed in the furnace or in an outlet of the furnace.

19. The method of claim 18, wherein calculating the oxygen level within the beater mill via the controller based at least in part on an oxygen level obtained by an oxygen sensor disposed in the furnace or in an outlet of the furnace comprises:

calculating a flow rate of the gas stream based at least in part on a rotational speed of the beater wheel.

* * * * *